US006398530B1

(12) United States Patent
Hasemann

(10) Patent No.: US 6,398,530 B1
(45) Date of Patent: Jun. 4, 2002

(54) SCROLL COMPRESSOR HAVING ENTRAINING MEMBERS FOR RADIAL MOVEMENT OF A SCROLL RIB

(75) Inventor: Thomas Hasemann, Boeblingen (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/711,165

(22) Filed: Nov. 9, 2000

Related U.S. Application Data

(63) Continuation of application No. PCT/EP00/01451, filed on Feb. 23, 2000.

(30) Foreign Application Priority Data

Mar. 10, 1999 (DE) ..... 199 10 460

(51) Int. Cl.[7] ..... F04C 18/04; F04C 29/02

(52) U.S. Cl. ..... 418/55.5; 418/55.6; 418/57; 418/94

(58) Field of Search ..... 418/55.5, 55.6, 418/57, 94

(56) References Cited

U.S. PATENT DOCUMENTS

| | | | | |
|---|---|---|---|---|
| 4,585,402 A | * | 4/1986 | Morishita et al. | 418/55.5 |
| 4,585,403 A | | 4/1986 | Inaba et al. | 418/55.5 |
| 4,715,796 A | * | 12/1987 | Inaba et al. | 418/55.5 |
| 5,295,813 A | | 3/1994 | Caillat et al. | 418/55.5 |
| 5,536,152 A | | 7/1996 | Kawahara et al. | 418/55.5 |
| 5,545,019 A | | 8/1996 | Beck et al. | 418/55.1 |
| 5,562,436 A | | 10/1996 | Kawahara et al. | 418/55.5 |
| 5,772,415 A | | 6/1998 | Monnier et al. | 418/55.5 |

FOREIGN PATENT DOCUMENTS

| | | | | |
|---|---|---|---|---|
| DE | 33 46 546 | | 6/1984 | |
| DE | 3404222 | | 9/1984 | |
| DE | 43 05 876 | | 9/1993 | |
| EP | 0 430 853 | | 6/1991 | |
| EP | 0 457 603 | | 11/1991 | |
| EP | 0 718 498 | | 6/1996 | |
| GB | 2 132 276 | | 7/1984 | |
| JP | 63-29083 | * | 2/1988 | 418/55.6 |
| WO | WO97/22808 | | 6/1997 | |

* cited by examiner

*Primary Examiner*—John J. Vrablik
(74) *Attorney, Agent, or Firm*—Barry R. Lipsitz

(57) ABSTRACT

In order to improve a compressor comprising a scroll compressor with a first compressor member and a second compressor member, a drive with a drive motor and an entraining unit which has an entraining member moving on an entraining path and an entraining member receiving means arranged on the second compressor member, wherein the compressor member receiving means is movable in a radial direction in relation to the central axis with a radial degree of freedom in relation to the entraining member, in such a manner that this can be produced as simply as possible and operates as reliably as possible it is suggested that the entraining member have an entraining member surface curved convexly in a direction transverse to the central axis in a direction of rotation, that the entraining member receiving means be non-rotatably arranged in relation to the second compressor member and have an entraining surface which surrounds the entraining member in a ring shape and on which the entraining member surface bears by always acting upon it with a force only in an orbiting subsection and that a space exist between the entraining member and the entraining surface outside the subsection acted upon with a force.

27 Claims, 4 Drawing Sheets

SCROLL COMPRESSOR HAVING ENTRAINING MEMBERS FOR RADIAL MOVEMENT OF A SCROLL RIB

The present disclosure relates to the subject matter disclosed in International Application No. PCT/EP00/01451 of Feb. 23, 2000, the entire specification of which is incorporated herein by reference.

BACKGROUND OF THE INVENTION

The invention relates to a compressor comprising a scroll compressor with a first compressor member and a second compressor member, first and second scroll ribs, respectively, of which are designed in the form of a circular involute and engage in one another such that the second compressor member can be moved in relation to the first compressor member on an orbital path about a central axis, a drive for the scroll compressor with a drive motor and an entraining unit which has an entraining member driven by the drive motor and moving on an entraining path about the central axis and an entraining member receiving means arranged on the second compressor member, wherein the entraining member receiving means can be moved in a radial direction in relation to the central axis with a radial degree of freedom in relation to the entraining member such that the second compressor member can be moved so as to abut sealingly with the second scroll rib on the first scroll rib of the first compressor member on account of the radial degree of freedom and the centrifugal forces acting on the second compressor member.

A scroll compressor of this type is known, for example, from U.S. Pat. No. 5,295,813.

The problem with these scroll compressors is that this solution is complicated to produce and, on the other hand, undesired, high, local area pressures can occur due to the flat entraining member surfaces.

SUMMARY OF THE INVENTION

The object underlying the invention is therefore to improve a compressor of the generic type in such a manner that this can be produced as simply as possible and operates as reliably as possible.

This object is accomplished in accordance with the invention, in a compressor of the type described at the outset, in that the entraining member has an entraining member surface curved convexly in a direction transverse to the central axis in a direction of rotation, that the entraining member receiving means is non-rotatably arranged in relation to the second compressor member and has an entraining surface which surrounds the entraining member in a ring shape and on which the entraining member surface bears by always acting upon it with a force only in a subsection, that during movement of the second compressor member on the orbital path the subsection acted upon with a force likewise moves on the entraining surface and that a space allowing the radial degree of freedom of the entraining member receiving means in relation to the entraining member exists between the entraining member and the entraining surface outside the subsection acted upon with a force.

The advantage of the inventive solution lies in its constructional simplicity which allows the entraining member receiving means, on the one hand, to be arranged on the second compressor member so as to no longer be rotatable but rather non-rotatable so that the rotary bearing required for this can be omitted since in the inventive solution the relative rotation is accomplished by the movement of the subsection on the entraining surface.

In addition, the inventive solution has the great advantage that it requires less parts and, in particular, only parts which are easy to machine.

A particularly simple solution from a constructional point of view provides for the entraining member receiving means to be securely arranged on the second compressor member.

In the constructionally simplest case, this is a bushing which is preferably integrally formed on the compressor member, the entraining member engaging in its inner recess.

With respect to the dimensioning of the possible radial degree of freedom it would also be conceivable to design this to be smaller than the maximum possible movements of the compressor member in a radial direction. It is, however, particularly favorable when the possible radial degree of freedom corresponds at least to the maximum deviation of the orbital path of the second compressor member from a geometrical circular path around the central axis. In this respect, the geometrical circular path around the central axis represents the ideal case of the orbital path which cannot, however, either be achieved from time to time or be maintained over a longer period on account of the manufacturing inaccuracies in the area of the scroll ribs, on account of thermal changes during operation, for example, varying temperature expansion or also on account of wear and tear and so it is to be assumed that the actual orbital path of the second compressor member deviates from the ideal geometrical circular path.

With respect to the dimensioning of the space it is particularly favorable when the space has in a radial direction an extension which corresponds at least to the maximum deviation of the orbital path from the geometrical circular path since, as a result, the space is in a position to allow the radial movements which are necessary so that the second compressor member always extends with its second scroll rib so as to lie along the first scroll rib of the first compressor member.

In a preferred embodiment the space has a dimension which is in the range of approximately 1.5‰ to approximately 15‰ of an extension of the entraining surface in a respective radial direction. Values of approximately 2‰ to approximately 10‰ are preferred.

With respect to the design of the space the most varied of solutions are conceivable. It would, for example, be conceivable for the space to become suddenly wider following the entraining member surface.

However, in order to provide for the fact that during a radial movement of the entraining member receiving means relative to the entraining member the radial movement is subject to a certain attenuation, it is preferably provided for the distance between them proceeding from the subsection acted upon with a force to become increasingly larger with increasing distance from the subsection, i.e. due to the continuous increase in the distance between the entraining member surface and the entraining surface a lubricant cushion forms close to the subsection acted upon with a force and this has to be expelled from the space during a sudden radial movement and thus a certain attenuation effect begins.

In this respect it is particularly favorable when the distance between the entraining member surface and the entraining surface on both sides of the subsection acted upon with a force increases with increasing distance from it so that a movement in a radial direction and also in the opposite direction thereto experiences a respective attenuation.

A particularly favorable solution with respect to the production of the entraining surface provides for the entraining surface to extend in a circular shape, preferably as a cylinder surface of a circular cylinder, so that during the movement of the second compressor member on the orbital path the entraining member surface moves along the entraining surface extending in a circular or cylindrical manner.

In this respect, the center point of the circle or cylinder formed by the entraining surface is preferably located on the circular path around the central axis which underlies the orbital path.

With respect to the design of the entraining unit, no further details have been given in conjunction with the preceding explanations concerning the invention. A most simple embodiment of an inventive entraining unit provides for this to have a single entraining member surface and an entraining surface associated with it. The space is preferably located between the entraining member and the entraining surface.

Another advantageous solution provides for the entraining surface associated with the entraining member surface to be arranged on an intermediate ring which, for its part, bears with an additional entraining member surface on an additional subsection of an additional entraining surface by acting upon it with a force and for an additional space contributing to the radial degree of freedom of the entraining member receiving means in relation to the entraining member to likewise exist between the intermediate ring and the additional entraining surface. The advantage of this solution is to be seen in the fact that it is possible to divide the radial degree of freedom which can be obtained altogether between at least two or more spaces so that these spaces can, for their part, be kept as small as possible in order to achieve as good a lubrication as possible in the area of the spaces but, on the other hand, the radial degree of freedom possible altogether in a radial direction can be as large as possible on account of the sum of the widths of the spaces in a radial direction.

With this embodiment it is not absolutely necessary for the intermediate ring to slide along the additional entraining surface with the additional entraining member surface. It is also conceivable for the intermediate ring to roll on the additional entraining surface with the additional entraining member surface.

As for the rest, it is also conceivable within the scope of the inventive solution for the entraining member surface to roll on the entraining surface even with only one entraining member surface and one associated entraining surface which does, however, make it necessary to realize the entraining member surface, for example, as an outer surface of a sleeve surrounding the entraining member and rotatably mounted on it so that the entraining member surface can, as entire outer surface of the sleeve, roll on the associated entraining surface during the movement of the second compressor member on the orbital path.

For reasons of as inexpensive a solution as possible it is, however, particularly favorable when at least one of the entraining member surfaces slides relative to the associated entraining surface during the movement of the second compressor member on the orbital path since this solution is particularly simple to realize and also allows a large degree of freedom with respect to the design of the member bearing this entraining member surface.

In the case of an entraining member surface sliding on the entraining surface it is important to have an optimum lubrication which can be obtained when a hydrodynamic lubrication film can be generated between the sliding entraining member surface and the associated entraining surface, this film contributing to the fact that no essentially linear abutment takes place between the entraining member surface and the entraining surface but rather the entraining member surface bears over an area with a greater expansion on account of the lubrication film.

For the formation of such a lubrication film it is particularly favorable when lubricant is supplied in front of the entraining member surface when seen in the direction of rotation of the entraining member so that the lubricant is moved during the rotary movement in the direction of the subsection acted upon with a force.

In this respect, it is particularly favorable when the supply of lubricant takes place via the entraining member.

Such a supply of lubricant to the entraining unit via the entraining member may be realized in the most varied of ways. It would be conceivable, for example, to allow lubricant to exit at the end side of the entraining member, this lubricant then moving in the direction of the space and passing into it. A particularly favorable solution provides for the entraining member to be provided for this purpose with a lubricant channel passing through it, wherein the lubricant channel preferably continues from the entraining member via the drive shaft and a lubricant pump is arranged, for example, at an end of the drive shaft of the drive motor located opposite the entraining member.

In order to achieve a particularly precise lubrication, it is preferably provided for the entraining member to be provided with a lubricant outlet opening opening near to the entraining member surface and into the space so that the lubricant is preferably introduced into the space directly in front of the entraining member surface and then moves from the space in the direction of the subsection acted upon with a force.

With respect to the design of the space, the most varied of possibilities are conceivable. However, in order to have the lubricant available in the area of the subsection acted upon with a force in as optimum a manner as possible, particularly for forming a hydrodynamic lubrication film, it is preferably provided for the space to have in front of the entraining surface when seen in the direction of rotation of the entraining member an extension which holds the lubricant on account of a capillary action.

It is even better when the space has over its entire extent such an extension that it holds lubricant on account of a capillary action.

With respect to the alignment of the entraining member surface in relation to the direction, in which the radial degree of freedom is effective, particularly in the direction of a connection line between the central axis and a contact line of the scroll ribs, no further details have so far been given.

It is, for example, particularly advantageous when the subsection of the entraining surface acted upon with a force always extends approximately parallel to the direction of the radial degree of freedom and retains this alignment so that, as a result, a defined alignment of the effect of the entraining member on the entraining member receiving means can be determined. In the ideal case, the subsection lies symmetrically to a tangent to the circular path underlying the orbital path, wherein the tangent extends through the center point of the circular entraining surface. In this case, the entraining member always acts on the second compressor member in such a manner that it is in a position to overcome the tangential gas force but does not make any contribution whatsoever towards the radial degree of freedom and so the radial gas force merely counteracts the centrifugal force.

It is, however, also conceivable to determine the subsection of the entraining surface acted upon with a force such that this has a slight inclination in relation to the direction of the radial degree of freedom and thus the fact that the tangential gas force is overcome by the entraining member leads either to an additional force component acting radially outwards in addition to the centrifugal force or to an additional force component acting radially inwards.

Additional features of the invention are the subject matter of the following description as well as the drawings illustrating several embodiments.

DETAILED DESCRIPTION OF THE INVENTION

Figure 1:
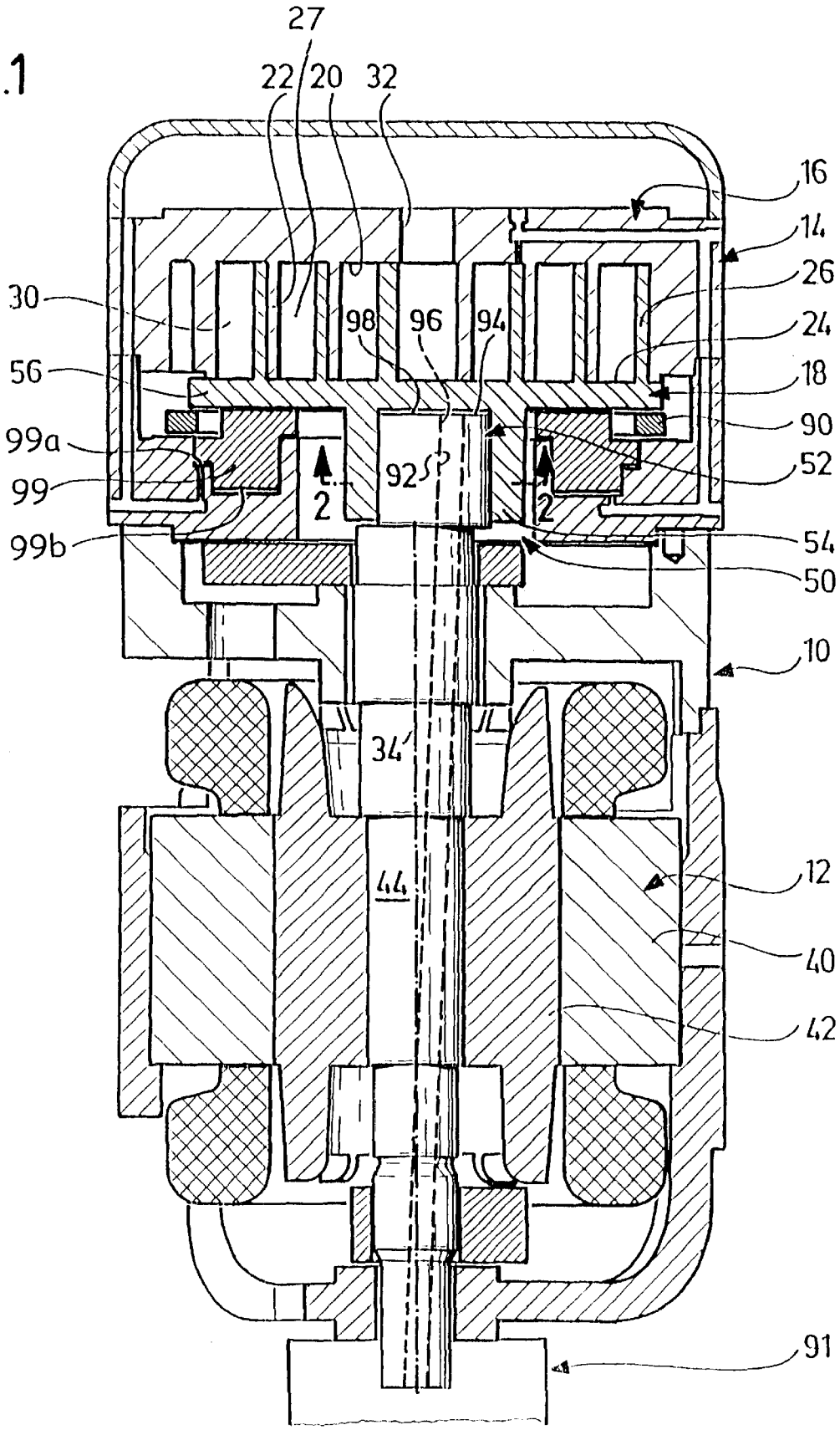
FIG. 1 shows a longitudinal section through a first embodiment of an inventive compressor.

One embodiment of an inventive scroll compressor, illustrated in FIG. 1, comprises a housing which is designated as a whole as 10 and in which an electric drive motor designated as a whole as 12 and a scroll compressor designated as a whole as 14 are arranged.

The scroll compressor comprises a first compressor member 16 and a second compressor member 18, wherein the first compressor member 16 has a first scroll rib 22 designed in the form of a circular involute and rising above a base surface 20 of the first compressor member and the second compressor member 18 has a scroll rib 26 designed in the form of a circular involute and rising above a base surface 24, wherein the scroll ribs 22, 26 engage in one another and thereby abut sealingly on the respective base surface 24 or 20 of the respectively other compressor member 18, 16 so that chambers 27 are formed between the scroll ribs 22, 26 as well as the base surfaces 20, 24 and in these chambers a compression of a medium takes place which flows in with initial pressure via an inlet chamber 30 surrounding the scroll ribs 22, 26 radially outwards and after the compression in the chambers 27 exits via an outlet 32, provided in the first compressor member 16, with an end pressure.

In the first embodiment as described, the first compressor member 16 is held securely in the compressor housing 10 whereas the second compressor member 18 is movable about a central axis 34 on an orbital path 36 relative to the first compressor member 16, wherein the scroll ribs 22 and 26 theoretically abut on one another along a contact line 28 and the contact line 28 likewise moves about the central axis 34 on the orbital path 36 during the movement of the second compressor member 18.

The drive motor 12 for driving the second compressor member 18 comprises a stator 40 which is securely arranged in the housing 10 and a rotor 42 which is seated on a drive shaft 44 which, for its part, is mounted in the housing 10 so as to be rotatable, namely about the axis 34.

To couple the rotary movement of the drive shaft 44 to the second compressor member 18, an entraining unit designated as a whole as 50 is provided and this comprises an eccentric 52 designed as an entraining member which is arranged so as to be offset in relation to the central axis 34, namely in a radial direction.

The entraining member 52 engages in an entraining member receiving means 54 which is designed as a bushing and arranged on a base part 56 of the second compressor member 18, namely on a side thereof located opposite the scroll rib 26 and points in the direction of the drive motor 12.

Figure 2:
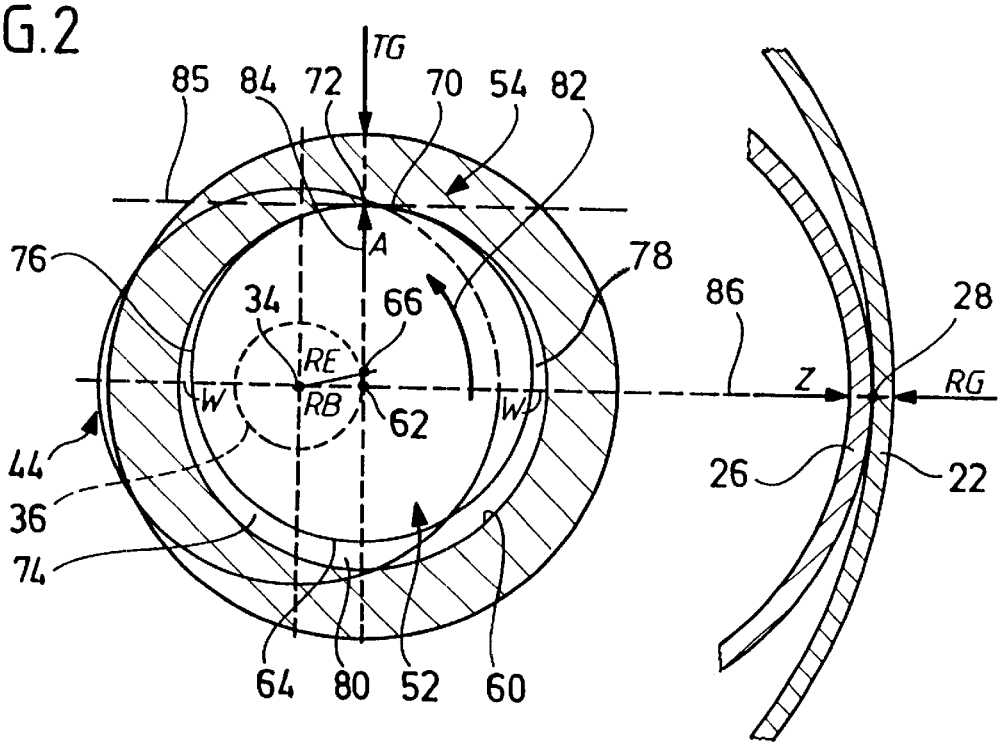
FIG. 2 shows an enlarged subsection along line 2—2 in FIG. 1 with additional illustration of a section of a first and a second scroll rib, with which overcoming of the tangential gas force does not lead to a radial force component.

As illustrated in FIG. 2, the entraining member receiving means 54 designed as a bushing has an inner cylinder surface 60, the cylinder axis 62 of which, on the one hand, intersects the theoretically circular orbital path 36, on the other hand, extends parallel to the central axis 34 but is arranged so as to be offset in relation to the central axis 34 by the radius of the orbital path 36.

The entraining member 52 designed as an eccentric is, for its part, likewise preferably designed as a cylindrical member with a cylinder casing surface 64, the cylinder axis 66 of which likewise extends parallel to the central axis 34 and, in addition, has a radial distance RE from it which corresponds approximately to the radius of the orbital path 36.

In accordance with the invention, the entraining member 52 is designed such that it abuts with an entraining member surface 70 on the inner cylinder surface 60 of the entraining member receiving means 54 acting as entraining surface in a subsection 72 thereof but, for the rest, extends without contact in relation to the entraining surface 60 so that proceeding from the subsection 72 a space 74 results between the entraining member 52 and the entraining member receiving means 54 which, first of all, adjoining the subsection 72 has areas 76 and 78, in which a width of the space becomes increasingly larger, and, with increasing width of the space 74, these areas 76 and 78 merge into an area 80 of maximum width, wherein the area 80 is, in the first embodiment, located opposite the subsection 72.

During the movement of the entraining member 52 about the central axis 34 in the direction of rotation 82, the entraining member surface 70 acts with a force A against the subsection 72 of the entraining surface 60 in order to overcome the tangential gas force TG. In an initial position, in which the cylinder axis 62 moves on the theoretically provided circular orbital path 36 about the central axis, the tangential gas force TG aligned in a direction 84 of a tangent to the orbital path 36 through the cylinder axis 62 acts in a neutral direction which, on the one hand, extends through the cylinder axis 66 as a curvature center point of the entraining member surface 70 and, on the other hand, extends through the cylinder axis 62 and is at right angles to a straight line 86 which connects the central axis 34 with the contact line 28 of the scroll ribs 22, 26. Since, in the initial position, a tangent 85, applied to the entraining member surface 70 in the subsection 72 at the point of intersection with the tangent 84 to the orbital path 36, extends parallel to the straight line 86 and thus parallel to the radial direction, the drive force A and the tangential gas force TG cancel one another without generating a force component effective in a radial direction to the central axis 34 and so the radial gas force RG acting on the second compressor member 18 in the area of the contact line 28 and in the direction of the connecting straight line 86 can be compensated exclusively by the centrifugal force Z which is likewise effective in the direction of the connecting straight line 86 in the area of the contact line 28.

Such a dimensioning makes it necessary to select the distance RE of the cylinder axis 66 of the entraining member 52 from the central axis 34 to be larger than the radius RB of the orbital path 36 since the cylinder axis 66 is offset in relation to the cylinder axis 62 in the direction of the subsection 72 acted upon with a force.

Figure 3:
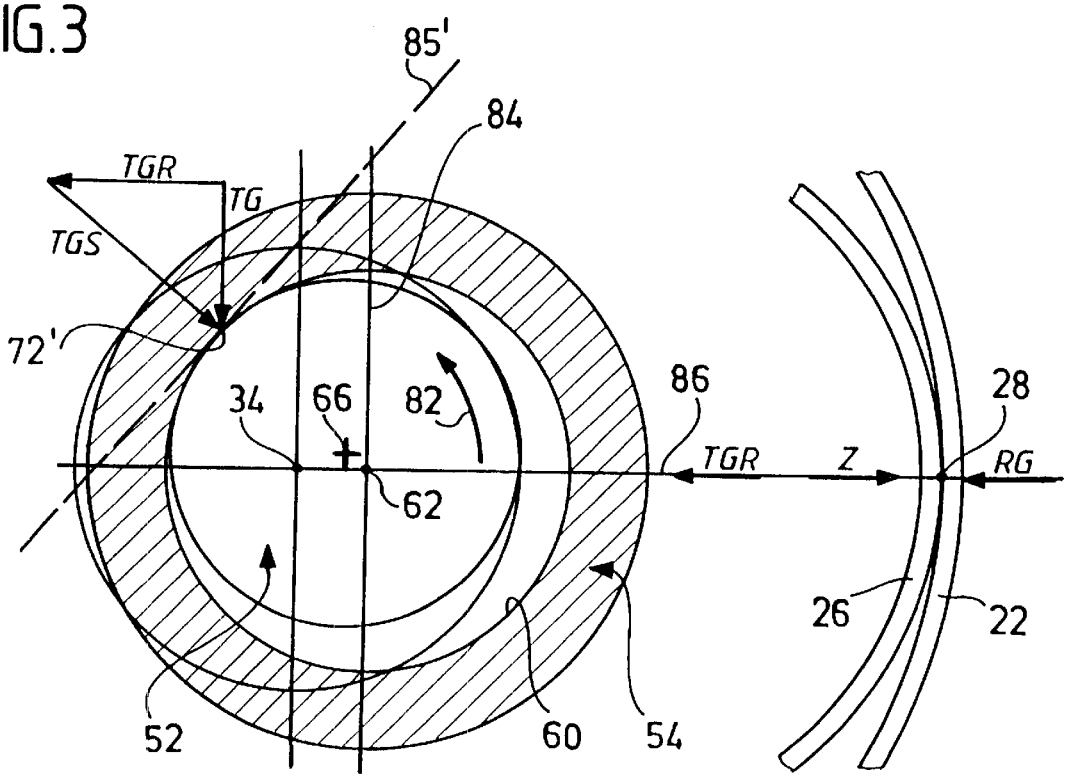
FIG. 3 shows an illustration of a layout of the first embodiment, wherein the overcoming of the tangential gas force leads to a force component in a radial direction.

However, there is also the possibility, as illustrated in FIG. 3, of having the tangential gas force TG act such that a component TGR effective in the radial direction 86 results. This case occurs when the cylinder axis 62 of the cylinder surface 60 is displaced either in the direction of the central axis 34 or away from it in relation to the initial position (FIG. 2), in which the cylinder axis 66 is located on the tangent 84. If, for example, as illustrated in FIG. 3, the cylinder axis 62 is displaced in relation to the cylinder axis away from the central axis 34 when seen in radial direction 86 and is thus located, in relation to the radial direction 86, on the side of the cylinder axis 66 located opposite the central axis 34, the subsection 72' is located in relation to the subsection 72 in the case according to FIG. 2 such that it is displaced in the direction of the central axis 34 towards it and thus the tangent 85', applied in the subsection 72', is inclined in relation to the radial direction 86 such that the tangential gas force TG effective parallel to the tangent 84 comprises a component TGS at right angles to the tangent 85' and a component TGR in the radial direction 86 which, in the case illustrated in FIG. 3, counteracts the centrifugal force Z and has an attenuating effect in the same direction as the radial gas force RG, i.e. with respect to the force, with which the scroll ribs 22, 26 abut on one another.

Such a radial component TGR of the tangential gas force can already be determined constructionally as a result of the fact that the distance RE is selected to be smaller than it would have to be for the initial position.

A radial component TGR does, however, also occur when the radius RB of the orbital path 36 increases on account of machining inaccuracies in the area of the scroll ribs 22, 26 abutting on one another in relation to the radius RB for the initial position.

A radial component TGR acting in the reverse, i.e. a component TGR having an intensifying effect with respect to the force, with which the scroll ribs 22, 26 abut on one another, results when the cylinder axis 62 is displaced towards the central axis 34 in relation to the cylinder axis 66 and, when seen in radial direction 86, is located between this and the cylinder axis 66, wherein the radial component TGR having an intensifying effect may either be predetermined constructionally or result due to a change in the radius of the orbital path 36 on account of inaccuracies.

During the movement of the entraining member 52 on the orbital path 36 the subsection 72 of the entraining surface 60 acted upon with a force moves each time in the direction of rotation 82 on the entraining member surface 60 since the second compressor member 18 is movable radially to the central axis 34 but is held so as to be non-rotatable about it by means of a customary Oldham coupling 90 relative to the housing 10.

On the other hand, the entraining member surface 70 of the entraining member 52 always remains the same since the entraining member 52 is rigidly connected to the drive shaft 44 and thus pivots about it with the central axis 34 as axis of rotation.

On account of the increasing width in the areas 76 and 78 of the space 74 between the entraining member 52 and the entraining member receiving means 54, the areas 76 and 78 of the space 74 have at the point, at which these are penetrated by the connecting straight line 86, a width W which allows a movement of the second compressor member 18 in a radial direction in relation to the central axis 34 so that, altogether, the second compressor member 18 with the scroll rib 26 has a radial degree of freedom in the direction of the line 86 which makes it possible for, on the one hand, the second scroll rib 26 to lift for a short time away from the first scroll rib 22 during the occurrence of liquid impacts and for the second scroll rib 26, in addition, to be in a position to compensate for manufacturing inaccuracies in the area of the scroll ribs 22 and 26, for example, on account of a lack of surface accuracies.

This means that with the present invention the guidance of the second compressor member 18 during the movement along the path in a radial direction is brought about by the scroll ribs 22 and 26 abutting on one another along the contact line 28 and so the orbiting movement of the second compressor member 18 does not generate, when viewed exactly, a theoretically circular orbital path 36 about the central axis 34 but rather deviates from this ideal geometrical circular path on account of manufacturing inaccuracies or heat expansions or wear and tear caused by operations. All this is compensated automatically by the second compressor member 18 on account of the centrifugal force Z acting on it since the entraining member receiving means 54 is in a position to carry out radial movements in relation to the central axis 34 on account of the width W of the space 74 in the areas 76 and 78.

The width W is configured such that this is at least as large as the resulting deviations of the orbital path 36 from the ideal geometrical circular path around the central axis 34.

On the other hand, it is advantageous not to make the width W too large in order to keep as small as possible any additional operating instability on account of further dynamic effects and, in particular, overshooting movements of the compressor member during liquid impacts. This is of advantage, in addition, for reasons of an optimum lubrication between the entraining member surface 70 and the entraining surface 60.

In one advantageous, practical form of realization the width W has been dimensioned such that it is in the order of magnitude of the deviations of the orbital path 36 from an ideal circular path. The width W is preferably in a range of approximately 1.5‰ to approximately 15‰ of the diameter of the circle determining the cylinder inner surface 60, preferably in the range of approximately 3‰ to approximately 10‰. In relation to a bearing clearance which would be necessary if the cylinder surface 64 of the entraining member 52 were to form a customary rotating friction bearing with the cylinder inner surface 60 of the entraining member receiving means 54, this means that the width W is at least 1.5 times a maximum customary bearing clearance and is smaller than six times a customary maximum bearing clearance.

The lubrication between the entraining member surface 70 and the entraining surface 60 is brought about by an oil channel 92 which passes through the drive shaft 44 and the entraining member 52 proceeding from an oil pump 91, ends on an end side 94 of the entraining member 52 facing away from the drive shaft 44 with an opening 96 and thus introduces oil into a chamber 98 between the end side 94 and the base plate 56 of the second compressor member 18, this oil then entering the space 74 from this chamber 98, wherein the space 74 is preferably dimensioned such that the oil is drawn into it by a capillary action, wherein a hydrodynamic lubrication film may be generated in the subsection 72 in a simple manner on account of the subsection 72 moving on the entraining surface 60.

As for the rest, the second compressor member 18 is movable, in addition, axially in the direction of the central axis 34 towards the first compressor member and is acted upon by a piston 99 which is mounted in the housing 10 and the pressure chambers 99*a, b* of which are connected via channels to the medium to be compressed which is subject to pressure and are thus acted upon by it.

Figure 4:
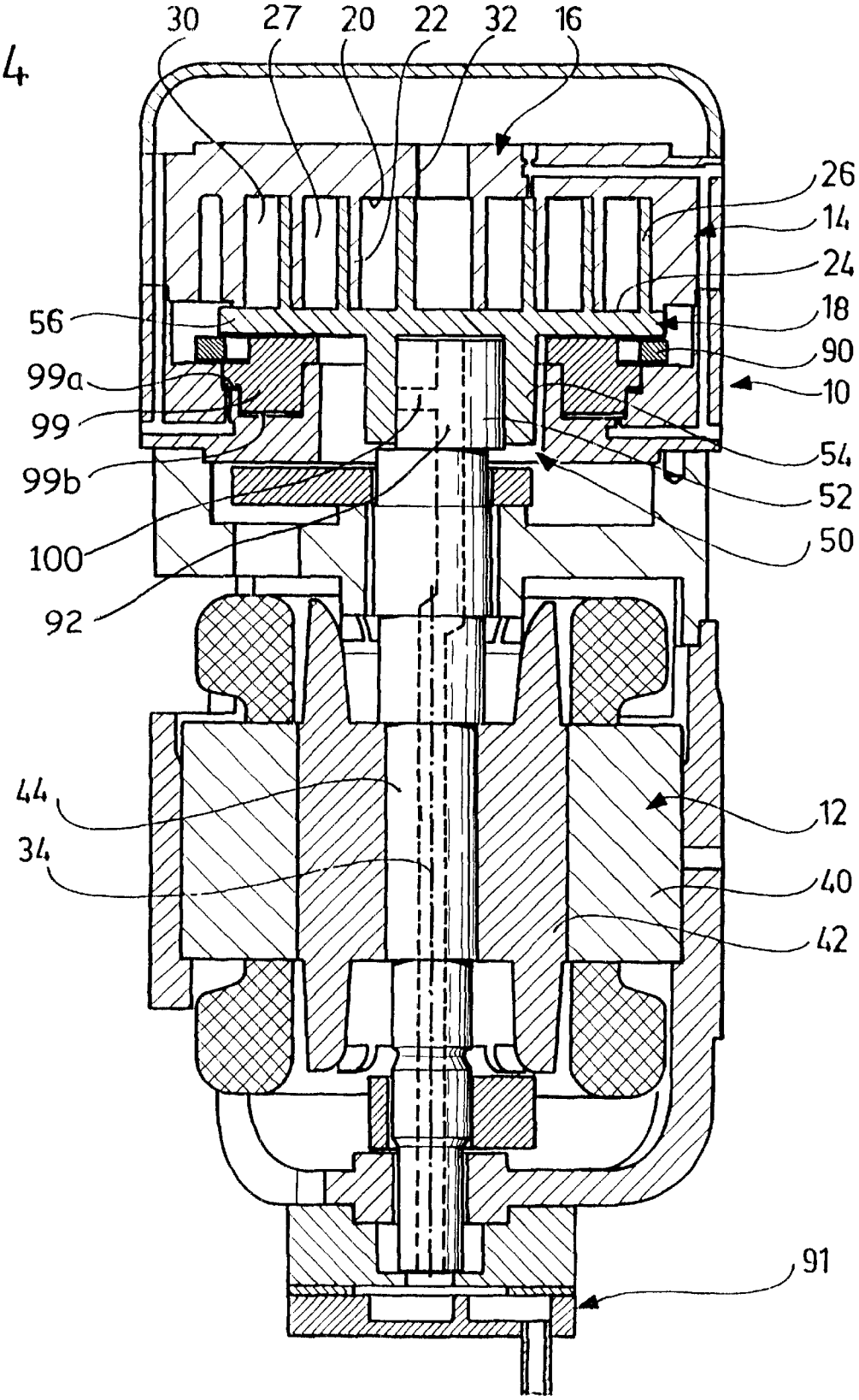
FIG. 4 shows a section similar to FIG. 1 through a second embodiment of an inventive compressor.
Figure 5:
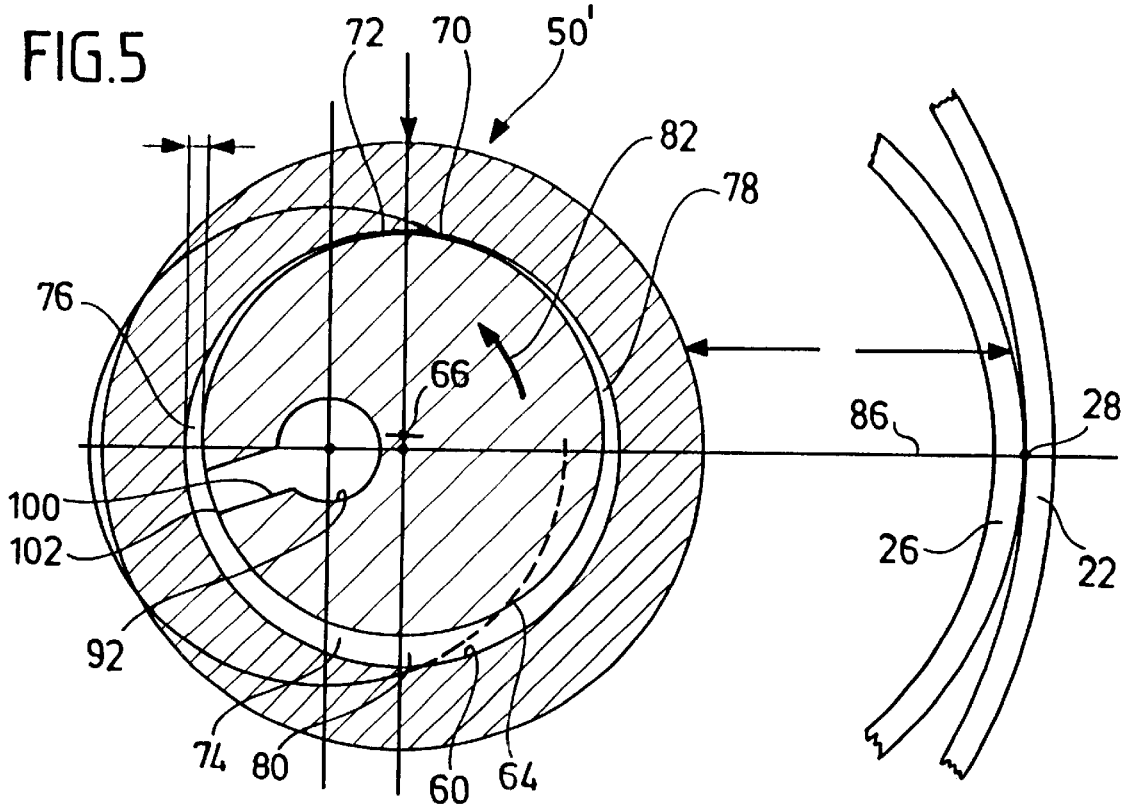
FIG. 5 shows a section similar to FIG. 2 through the second embodiment.
Figure 6:
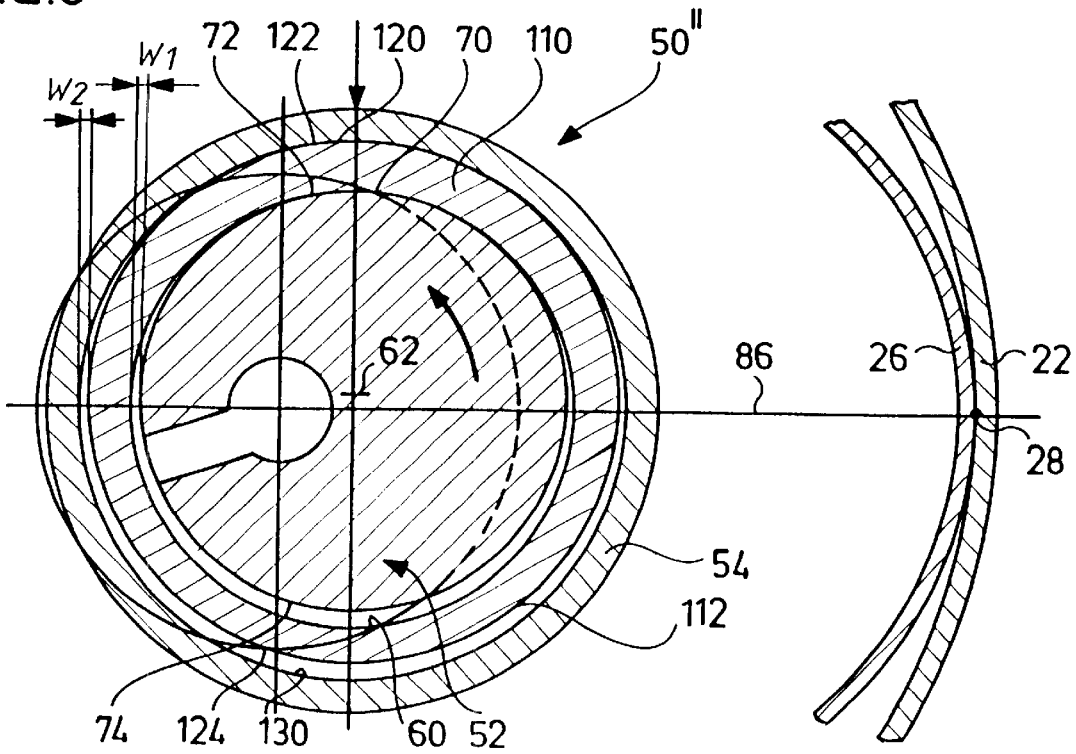
FIG. 6 shows a section similar to FIG. 2 through a third embodiment of an inventive compressor.

In a second embodiment, illustrated in FIGS. 4 and 5, the oil channel 92 is provided with a transverse channel 100 which extends radially to the cylinder axis 66 and ends with an opening 102 which is located in the cylinder surface 64 but is arranged so as to be offset forwards in relation to the entraining member surface 70 when seen in the direction of rotation 82 so that oil is supplied to the area 76 of the space 74 which runs ahead of the subsection 72 acted upon with a force during the movement of the second compressor member 18 on the orbital path 36, this oil then moving in the direction of the subsection 72 and leading in the area of the subsection 72 between the entraining surface 60 and the entraining member surface 70 to a hydrodynamic oil film which lies between the entraining member surface 70 and the subsection 72 of the entraining surface 60 acted upon with a force.

As for the rest, the second embodiment is designed in the same way as the first embodiment and so the same parts are given the same reference numerals and in this respect reference can be made in full to the explanations concerning the first embodiment.

In a third embodiment of an inventive scroll compressor, the entraining unit 50" is designed such that the entraining member 52 acts with the entraining member surface 70 on an intermediate ring 110 which bears the entraining surface 60, the subsection 72 of which is acted upon with a force by the entraining member surface 70. The intermediate ring 110 does, however, also have an outer cylinder surface 112 which is arranged coaxially to the entraining surface 60 and forms an entraining member surface 120 which, for its part, then acts on an entraining surface 130 designed as a cylinder surface in relation to the cylinder axis 62, wherein the additional entraining member surface 120 acts only in the area of an additional subsection 122 on the additional entraining surface 130 which represents an inner surface of the entraining member receiving means 54.

Thus, an additional space 124 is provided in addition to the space 74, and both spaces 74 and 124 contribute to the radial degree of freedom of the entraining member receiving means 54 relative to the entraining member 52.

This solution has the advantage that the widths $W_1$ and $W_2$ of the spaces 74 and 124 contributing to the radial degree of freedom in the direction of the connection line 86 are added together so that altogether the spaces 74 and 124 can each have individually a smaller width $W_1$ and $W_2$, respectively, but altogether the movability of the second compressor member 18 with the second scroll rib 26 required for the radial degree of freedom results from the sum of the two widths $W_1$ and $W_2$ so that despite smaller widths of the individual spaces 74 and 124 altogether an adequately large radial movability can be achieved.

The small widths $W_1$ and $W_2$ of the spaces 74 and 124 also allow a good lubrication and an even better attenuation against oscillating movements of the second compressor member relative to the entraining member 52 since the possibility exists of maintaining a supply of oil in the spaces 74 and 124 which can, indeed, be displaced in order to carry out a movement in a radial direction, wherein, however, it acts in an attenuating manner in relation to higher frequency oscillating movements as a result of the displacement.

As for the rest, those parts of the third embodiment which are identical to those of the preceding embodiments are provided with the same reference numerals and so with respect to the further description thereof reference can be made in full to the explanations concerning the preceding embodiments.

What is claimed is:

1. A compressor comprising:

a scroll compressor with a first compressor member and a second compressor member, said compressor members having first and second scroll ribs, respectively, in the form of a circular involute and engaging in one another such that the second compressor member is movable in relation to the first compressor member on an orbital path about a central axis, a drive for the scroll compressor with a drive motor and an entraining unit having an eccentric body fixed on said drive shaft as an entraining member driven by the drive motor and moving on an entraining path about said central axis, and an entraining member receiving means provided on the body of the second compressor member, the entraining member receiving means being movable in a radial direction in relation to said central axis with a radial degree of freedom in relation to the entraining member, such that the second compressor member is movable so as to sealingly abut with the second scroll rib on the first scroll rib of the first compressor member on account of the radial degree of freedom and the centrifugal forces acting on the second compressor member, the entraining member having an entraining member surface curved convexly in a direction transverse to the central axis in a direction of rotation, the entraining member receiving means being non-rotatably arranged in relation to the second compressor member and having an entraining surface surrounding the entraining member in a ring shape, the entraining member surface bearing on said entraining surface by always acting upon it with a force only in a subsection, during movement of the second compressor member on the orbital path, the subsection acted upon with a force likewise moving on the entraining surface, and a space allowing the radial degree of freedom of the entraining member receiving means in relation to the entraining member existing between the entraining member and the entraining surface outside the subsection acted upon with a force.

2. A compressor as defined in claim 1, wherein the possible radial degree of freedom corresponds at least to a maximum deviation of the orbital path from a geometrical circular path around the central axis.

3. A compressor as defined in claim 1, wherein said space has in a radial direction an extension corresponding at least to a maximum deviation of the orbital path from the geometrical circular path.

4. A compressor as defined in claim 1, wherein the entraining unit has a single entraining member surface and an entraining surface associated with it.

5. A compressor as defined in claim 1, wherein the entraining surface and the entraining member surface are dimensioned such that the distance between them proceeding from the subsection acted upon with a force becomes increasingly larger with increasing distance from the subsection.

6. A compressor as defined in claim 5, wherein the distance between the entraining member surface and the entraining surface on both sides of the subsection acted upon with a force becomes increasingly larger with increasing distance from it.

7. A compressor as defined in claim 1, wherein the entraining surface extends in a circular shape.

8. A compressor as defined in claim 7, wherein a center point of the circle formed by the entraining surface is located on the circular path underlying the orbital path.

9. A compressor comprising:

a scroll compressor with a first compressor member and a second compressor member, said compressor members having first and second scroll ribs, respectively, in the form of a circular involute and engaging in one another such that the second compressor member is movable in relation to the first compressor member on an orbital path about a central axis, a drive for the scroll compressor with a drive motor and an entraining unit having an entraining member fixed on said drive shaft driven by the drive motor and moving on an entraining path about said central axis, and an entraining member cooperating means non-rotatably provided on the body of the second compressor member, said entraining member and said entraining member cooperating means comprising a pin and an opening in which said pin extends, the entraining member cooperating means being movable in a radial direction in relation to said central axis with a radial degree of freedom in relation to the entraining member, such that the second compressor member is movable so as to sealingly abut with the second scroll rib on the first scroll rib of the first compressor member on account of the radial degree of freedom and the centrifugal forces acting on the second compressor member, one of said entraining member and said entraining member cooperating means having a surface curved convexly in a direction transverse to the central axis in a direction of rotation, the other of said entraining member and said entraining member cooperating means having a surface surrounding the convex surface in a ring shape, said convex surface bearing on said ring surface by always acting upon it with a force only in a subsection, during movement of the second compressor member on the orbital path, the subsection acted upon with a force likewise moving on the ring surface, a space allowing the radial degree of freedom of the entraining member cooperating means in relation to the entraining member existing between the entraining member and the ring surface outside the subsection acted upon with a force.

10. A compressor as defined in claim 9, wherein the space has in front of the entraining member surface, when seen in a direction of rotation of the entraining member, an extension holding a lubricant via capillary action.

11. A compressor as defined in claim 9, wherein the space has over its entire extent such an extension that it holds lubricant on account of a capillary action.

12. A compressor as defined in claim 9, wherein a hydrodynamic lubrication film is capable of being generated between the entraining member surface and the associated entraining surface.

13. A compressor as defined in claim 12, wherein the lubricant is supplied in front of the entraining member surface when seen in a direction of rotation of the entraining member.

14. A compressor as defined in claim 12, wherein the lubricant is supplied via the entraining member.

15. A compressor as defined in claim 14, wherein the entraining member is provided with a lubricant outlet opening which opens proximate to the entraining member surface and into the space.

16. A compressor as defined in claim 14, wherein the entraining member is provided with a lubricant channel passing therethrough.

17. A compressor as defined in claim 16, wherein the lubricant channel is fed via a lubricant channel passing through a drive shaft of the drive motor.

18. A compressor comprising:

a scroll compressor with a first compressor member and a second compressor member, said compressor members having first and second scroll ribs, respectively, in the form of a circular involute and engaging in one another such that the second compressor member is movable in relation to the first compressor member on an orbital path about a central axis, a drive for the scroll compressor with a drive motor and an entraining unit having an entraining member driven by the drive motor and moving on an entraining path about said central axis, and an entraining member receiving means arranged on the second compressor member, the entraining member receiving means being movable in a radial direction in relation to said central axis with a radial degree of freedom in relation to the entraining member, such that the second compressor member is movable so as to sealingly abut with the second scroll rib on the first scroll rib of the first compressor member on account of the radial degree of freedom and the centrifugal forces acting on the second compressor member, the entraining member receiving means being non-rotatably arranged in relation to the second compressor member and having an entraining surface surrounding the entraining member in a ring shape, the entraining member having an entraining member surface curved convexly in a direction transverse to the central axis in a direction of rotation, the entraining member surface bearing on said entraining surface by always acting upon it with a force only in a subsection, during movement of the second compressor member on the orbital path, the subsection acted upon with a force likewise moving on the entraining surface, a space allowing the radial degree of freedom of the entraining member receiving means in relation to the entraining member existing between the entraining member and the entraining surface outside the subsection acted upon with a force, the entraining surface associated with the entraining member surface being arranged on an intermediate ring which bears with an additional entraining member surface on a subsection of an additional entraining surface by acting upon the subsection with a force, and an additional space contributing to the radial degree of freedom of the entraining member receiving means in relation to the entraining member likewise existing between the intermediate ring and the additional entraining surface.

19. A compressor as defined in claim 18, wherein one of the entraining surfaces is arranged so as to be stationary relative to the second compressor member.

20. A compressor as defined in claim 18, wherein one of the entraining member surfaces rolls on the associated entraining surface.

21. A compressor as defined in claim 18, wherein at least one of the entraining member surfaces slides relative to the associated entraining surface during the movement of the second compressor member on the orbital path.

22. A compressor comprising:

a scroll compressor with a first compressor member and a second compressor member, said compressor members having first and second scroll ribs, respectively, in the form of a circular involute and engaging in one another such that the second compressor member is movable in relation to the first compressor member on an orbital path about a central axis, a drive for the scroll compressor with a drive motor and an entraining unit having an entraining member driven by the drive motor and moving on an entraining path about said central axis, and an entraining member receiving means arranged on the second compressor member, the entraining member receiving means being movable in a radial direction in relation to said central axis with a radial degree of freedom in relation to the entraining member, such that the second compressor member is movable so as to sealingly abut with the second scroll rib on the first scroll rib of the first compressor member on account of the radial degree of freedom and the centrifugal forces acting on the second compressor member, the entraining member receiving means being non-rotatably arranged in relation to the second compressor member and having an entraining surface surrounding the entraining member in a ring shape, the entraining member having an entraining member surface curved convexly in a direction transverse to the central axis in a direction of rotation, the entraining member surface bearing on said entraining surface by always acting upon it with a force only in a subsection, during movement of the second compressor member on the orbital path, the subsection acted upon with a force likewise moving on the entraining surface, a space allowing the radial degree of freedom of the entraining member receiving means in relation to the entraining member existing between the entraining member and the entraining surface outside the subsection acted upon with a force, a hydrodynamic lubrication film being generatable between the entraining member surface and the associated entraining surface, the supply of lubricant taking place via the entraining member, the entraining member being provided with a lubricant outlet opening which opens into the space.

23. A compressor as defined in claim 22, wherein lubricant is supplied in front of the entraining member surface when seen in a direction of rotation of the entraining member.

24. A compressor as defined in claim 22, wherein the entraining member is provided with a lubricant channel passing therethrough.

25. A compressor as defined in claim 22, wherein the lubricant channel is fed via a lubricant channel passing through a drive shaft of the drive motor.

26. A compressor as defined in claim 22, wherein the space has in front of the entraining member surface, when seen in a direction of rotation of the entraining member, an extension holding the lubricant via capillary action.

27. A compressor as defined in claim 22, wherein the space has over its entire extent such an extension that it holds the lubricant on account of a capillary action.

* * * * *